United States Patent [19]

Remmler et al.

[11] 4,307,884

[45] Dec. 29, 1981

[54] ACTUATING DEVICE FOR THE PLAYING FIGURES OF A SOCCER GAME APPARATUS

[76] Inventors: Heinz Remmler; Andreas Remmler, both of An den Grundwiesen 65, 6078 Neu Isenburg, Fed. Rep. of Germany

[21] Appl. No.: 146,623

[22] Filed: May 5, 1980

[30] Foreign Application Priority Data

May 7, 1979 [DE] Fed. Rep. of Germany ..... 2918351

[51] Int. Cl.[3] ..... A63F 7/06

[52] U.S. Cl. ..... 273/85 D

[58] Field of Search ..... 273/85 D, 85 B, 85 C, 273/85 A, 85 R, 85 F, 129 R, 129 W, 129 V

[56] References Cited

U.S. PATENT DOCUMENTS

| | | | |
|---|---|---|---|
| 1,615,491 | 1/1927 | Thornton | 273/85 D X |
| 3,428,316 | 2/1969 | Cane | 273/85 B |
| 3,475,028 | 10/1969 | Rodorigd et al. | 273/85 B |
| 4,065,128 | 12/1977 | Gomori | 273/85 D |
| 4,212,466 | 7/1980 | Wildman | 273/129 V X |

FOREIGN PATENT DOCUMENTS

| | | | |
|---|---|---|---|
| 621958 | 12/1962 | Belgium | 273/85 D |
| 985312 | 3/1951 | France | 273/85 D |
| 424582 | 5/1967 | Switzerland | 273/85 D |
| 595862 | 2/1978 | Switzerland | 273/85 D |

*Primary Examiner*—Paul E. Shapiro

*Attorney, Agent, or Firm*—Barlow & Barlow

[57] ABSTRACT

An actuating device for the playing figures of a ball game apparatus is disclosed and includes a box viewable from above in which transverse rods, each carrying at least one playing figure, are journalled. The rod section carrying the playing figure(s) has an axially fixed handle externally of the box and is rotatable about its longitudinal axis as well as also movable in its longitudinal direction. Each handle is rotatably journalled on the associated transverse rod and each transverse rod is coupled through a coupling that is actuated by its handle. The coupling includes a rotary drive that rotates the rod over a predetermined rotational angle and includes a brake that arrests at about the end of a complete revolution.

9 Claims, 10 Drawing Figures

ACTUATING DEVICE FOR THE PLAYING FIGURES OF A SOCCER GAME APPARATUS

BACKGROUND OF THE INVENTION

The invention concerns an actuating device for the playing figures of a soccer game apparatus with a box viewable into from above, with transverse rods, which each carry at least one playing figure secured against rotation, the rods being journalled in the longitudinal walls of the box and rotatable about their longitudinal axis as well as being displaceable in their longitudinal direction at least in the rod section carrying the playing figure and displaying an axially fast handle externally of the box.

In a known apparatus of this kind (French Pat. No. 1,034,971), the transverse rods must be turned by hand in order on the one hand to bring the playing figures into an about vertical initial position and on the other hand by a playing figure to kick against the ball lying in the box. Since the transverse rods must be displaced axially in order to bring the playing figure lying next to the ball into a suitable shooting position at the height of the ball, the manipulation of the transverse rods is difficult.

In another known ball game apparatus U.S. Pat. No. 4,065,128, the transverse rod carrying a playing figure is displaceable in longitudinal direction of the transverse rod through a rope pull by means of a manual lever and pivotable against the force of a restoring spring through actuation of a solenoid, the armature of which is articulated to a lever connected with the transverse rod. A rope pull is however expensive and susceptible to faults. The acceleration of the ball attainable by means of solenoids is small because of the only gradually increasing magnetic force. When the ball lies closely behind the playing figure, then it may not be kicked forwardly. Beyond that, the danger of kicking the ball into one's own goal exists to a high degree through the frequent return movements of the playing figures.

It is furthermore known from German specification No. 1 453 946 to displace two-legged playing figures each on an individual rope pull where the direction of advance is determined by pressing a rope driving roller by means of a hand lever against the one or other of two shafts constantly rotating in opposite sense. On a reversal of direction of advance, the playing figure is pivoted through about 180° around a vertical axis which runs through the one leg of the playing figure. This actuating device is likewise expensive and susceptible to faults. The ball can be kicked only when it co-incidentally lies in the direction of movement of a playing figure. The danger of kicking the ball into one's own goal again exists during the return movement of the playing figures.

Then, it is known (Swiss Pat. No. 595,862) to mount the transverse rods to be elastically pivotable downwardly on the side of the handle and to actuate an electrical switch during a downward movement. The elastic mounting and the switch, however, merely make possible the indication of an overload of the transverse rod on actuation of the handle.

In Swiss Patent Specification No. 334,675, telescopic transverse rods are disclosed.

SUMMARY OF THE INVENTION

A soccer game apparatus, as generally disclosed in French Pat. No. 1,034,971, is provided with an actuating device for the playing figures that has a simpler operation during the kicking of the ball. According to the invention, each handle is rotatably journalled on an associated transverse rod and each transverse rod is connected through a coupling actuable from its handle with a rotary drive over a predetermined rotational angle and arrestable at about the end of a complete revolution by means of an automatically trippable brake.

With this construction the rotary movement of a desired transverse rod is triggered by actuation of the coupling from the handle of the transverse rod without rotary movement having to be executed by hand. At the end of the rotary movement of the transverse rod, the rod substantially assumes its initial position. The new setting of the initial position by hand is also obviated when the ball is co-incidentally again disposed in front of a playing figure of the same transverse rod. The rotary drive is constantly in operation before coupling to the desired transverse rod, so that the rotary movement is released practically without delay by the coupling process and executed with a correspondingly higher speed. In practice, the rotational speed of the rotary drive can be chosen to be so high that the transverse rod executes one or more revolutions within a fraction of a second. The ball hit by a playing figure on the driven transverse rod is therefore correspondingly strongly accelerated. The simplified manipulation makes it possible even for unpractised players to operate the gaming apparatus to high perfection after a relatively short time. The player can direct his attention mainly to the transverse displacement of his playing figures and the conveying of the ball into kicking position. In conjunction with the higher speed of flight of the ball hit by a rotating playing figure, the fascination of the game is increased appreciably by comparison with known gaming apparatus. Since the playing figures are turned in only one direction, the danger of own goals is largely excluded. Due to the fact that every handle is rotatably journalled on an associated transverse rod, it can be held fast during the rotary movement of the transverse rod.

It is preferred to use an electromagnetically actuable coupling and brake for each transverse rod. These elements may be actuated easily from the respective handle and respond practically without delay. Preferably, the drive coupling and brake co-axially surround the transverse rod and between them display a common ring arrangement, which is rotatable in a frame fastened to the box, mounted secured against rotation on the transverse rod and axially displaceable at least by its axial end regions and magnetically arrestable alternately on a coupling part fixed to the frame and a brake part fixed to the frame. In this case, the coupling as well as also the braking force acts on the entire circumference of the associated transverse rod so that it is not eccentrically loaded and is accelerated or braked with correspondingly high force. The alternating actuation of coupling and brake makes certain that drive and brake do not counteract.

It is particularly favorable to pivotally mount each transverse rod so that the associated coupling is actuable through a pivotal movement of its transverse rod. The pivotal movement of the transverse rod is easily performed by rocking the associated handle and requires no particular attention. The manipulation is particularly simple when each transverse rod is mounted to be pivotable in a vertical plane and a switch for the actuation of the coupling associated with the transverse rod may be actuated by the downward movement of the handle of the transverse rod. In this case, the bearing of each transverse rod, which lies on the side of the handle, is elastically mounted and the associated coupling and brake are arranged at the other end of the transverse rod. This results in a simple pivotal mounting of the transverse rod.

Preferably, the transverse rods are multisided, especially four-cornered, and mounted in correspondingly multisided passages of axially fast, rotatably journalled bearing rings. This makes possible in simple manner an axial displacement of the desired transverse rod in order to bring a playing figure into kicking position, while the transverse rod is simultaneously drivable or brakable from the handle or through at least one of the bearing rings. Preferably, the bearing rings display sleeve bearing rings of synthetic material. Bearings of that kind are particularly easily manufacturable and free of maintenance.

Furthermore, it is favorable when the transverse rods are telescopic and the rod parts remote from the handles are axially stationary, while the other rod parts carry the playing figure or figures. The axially stationary part is then not also displaced along with the axial positioning of the playing figures so that it need not project out of the box and correspondingly does not obstruct the other player or players.

Also, each handle can be mounted on multisidedly apertured sleeve bearing rings of synthetic material, which are penetrated by the associated correspondingly multisided transverse rod. In this case, it is favorable when at least one of the sleeve bearing rings of the handle is subdivided into two mutually sprung part rings. In this manner, the sliding friction of at least the subdivided sleeve bearing ring is increased so that the handle does not let itself be turned too easily on the transverse rod and the transverse rod can also be turned by means of the handle.

Preferably, the box is covered by a transparent pane and the bottom of the box is mounted to be pivotable relative to those walls of the box, which are fixed to the frame. The transparent pane makes certain that the interior of the box is not accessible for reasons of safety to avoid an injury of the hand through a soccer playing figure set into rotation, but yet readily viewable into. By pivoting the bottom of the box, the ball, when it comes to rest in a position inaccessible for a soccer playing figure, can be moved out of this rest position. In this case, the bottom of the box can be suspended resiliently relative to the box walls in order to restore the bottom automatically again into the initial position after pivoting. At least one handle, which facilitates the pivoting of the bottom, can be fastened to the bottom of the box. Then, care can be taken that projections, standing up from lateral arms of the box bottom, project with play through guide slots into a frame part and engage by transverse spigots into centring grooves. In this manner, the box bottom is centered again automatically in its initial position after pivoting.

The playing figures can in known manner consist of elastically flexible material in order to insure that a playing figure, which hits obliquely from above onto the ball, which mostly consists of solid material, bends and slides away over the ball so that neither the playing figure nor the rotary drive are damaged and, at the same time, they can be clamped fast in the region of their passage, penetrated by a multisided transverse rod, between correspondingly multisided clamping brackets on the transverse rod.

The control device for coupling and brake of each transverse rod can be constructed in the manner that one input of a logic element is connected with the switch delivering a signal on actuation, while the second input is connected to a transverse rod rotational angle sensor, which responds by the delivery of a signal shortly before the vertical position of the soccer playing figure(s) of each transverse rod. The output of the logic element is then connected through a timing member with the coupling coil and through a delayable responding timing generator stage with an input of a second logic element. The second input of the second logic element is likewise connected with the output of the transverse rod rotational angle sensor and the output of the second logic element with the brake coil. In this manner, the coupling and braking operation in a transverse rod are performed automatically one after the other. The coupling operation can however be tripped only when the transverse rod assumes a predetermined initial rotational angle position. On the other hand, a driven transverse rod is automatically braked in approximately the initial rotational angular position. In this case, the delay time of the timing generator stage can be chosen to be longer than the running time of the timing member so that the current flows in the coupling coil and the brake coil do not overlap in time. A construction of the transverse rod rotational angle sensor with a light barrier is particularly simple. This can contactlessly scan the rotary angle position of a transverse rod without influencing the driving or braking operation. When the light barrier is constructed as reflective light barrier, the ray path can be disposed radially with respect to the rotational axis of the transverse rod so that spatial accommodation difficulties with respect to the light emitter and receiver are largely avoided. Then, the output signal of the first logic element can be fed through a differentiating member to the timing member and the timing generator stage. In this manner, a continued actuation of the switch will have no influence on the running time of the timing member or the delay and running time of the timing generator stage, all times rather being triggered and arrived at independently of the duration of the actuation of the switch.

DESCRIPTION OF THE PREFERRED EMBODIMENT

Figure 1:
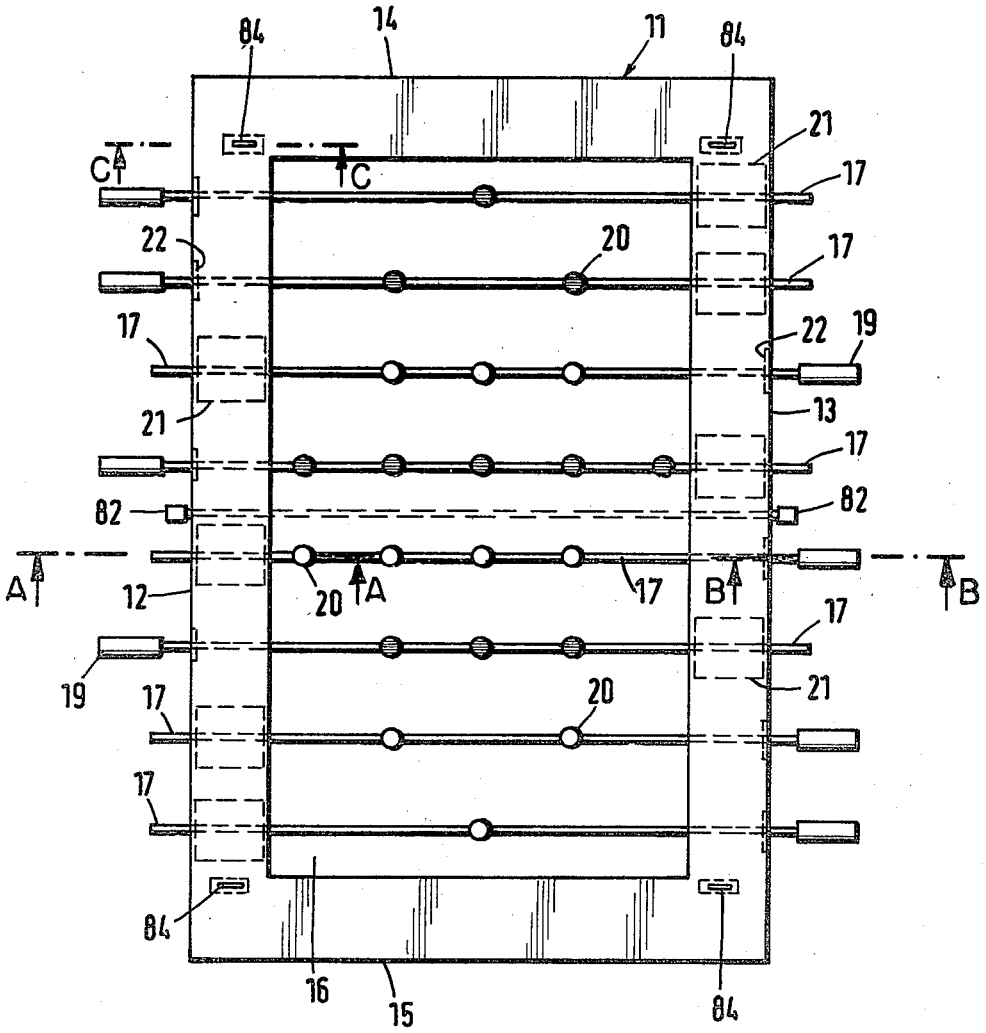
FIG. 1 is a plan view of a ball game apparatus according to the invention shown in the form of a table.

The soccer game apparatus illustrated in FIG. 1 displays an elongate box 11, the walls 12, 13, 14 and 15 of which are hollow, that may be supported on a frame with legs (not illustrated). The bottom 16 of the box 11 is resiliently suspended on the walls fixed to the frame as will presently appear. The box 11 may be viewed from above, however, for reasons of safety, may be covered by a transparent or glass plate (not illustrated).

Eight transverse rods 17 are passed through the longitudinal walls 12 and 13. They are provided respectively at one end with a handle 19 and are mounted to be axially displaceable as well as rotatable. In the interior of the box 11, the transverse rods 17 carry playing figures 20, of which the shaded or black ones belong to the player and the white ones to the other party. The ball playing figures 20 are securely fastened against rotative and axial movement on the transverse rods 17. The end of each transverse rod 17 not provided with a handle 19 (see FIG. 2) is surrounded by a coupling and braking arrangement 21 in the hollow space of the longitudinal walls 12 and 13. The transverse rods 17 are pivotable in a vertical plane, co-inciding with their longitudinal axis, by depression of their handle 19. For this purpose, the bearings 22, lying in the proximity of the handles 19, of all transverse rods 17 are resiliently suspended at the longitudinal walls 12 and 13 and the transverse rods 17 are passed through enlarged apertures in the longitudinal walls 12 and 13 that permits freedom of movement (see FIG. 3).

Through the pivotation, all transverse rods 17 are connectible through their coupling sheave 36 with a common, not illustrated, rotary drive constantly running at high rotational speed. The coupling to the rotary drive, an electrical motor, takes place during a fraction of a complete revolution of the actuated transverse rod. Thereafter, a brake is tripped automatically, which brakes the rotary movement of the transverse rod up to the end of a complete revolution.

Figure 2:
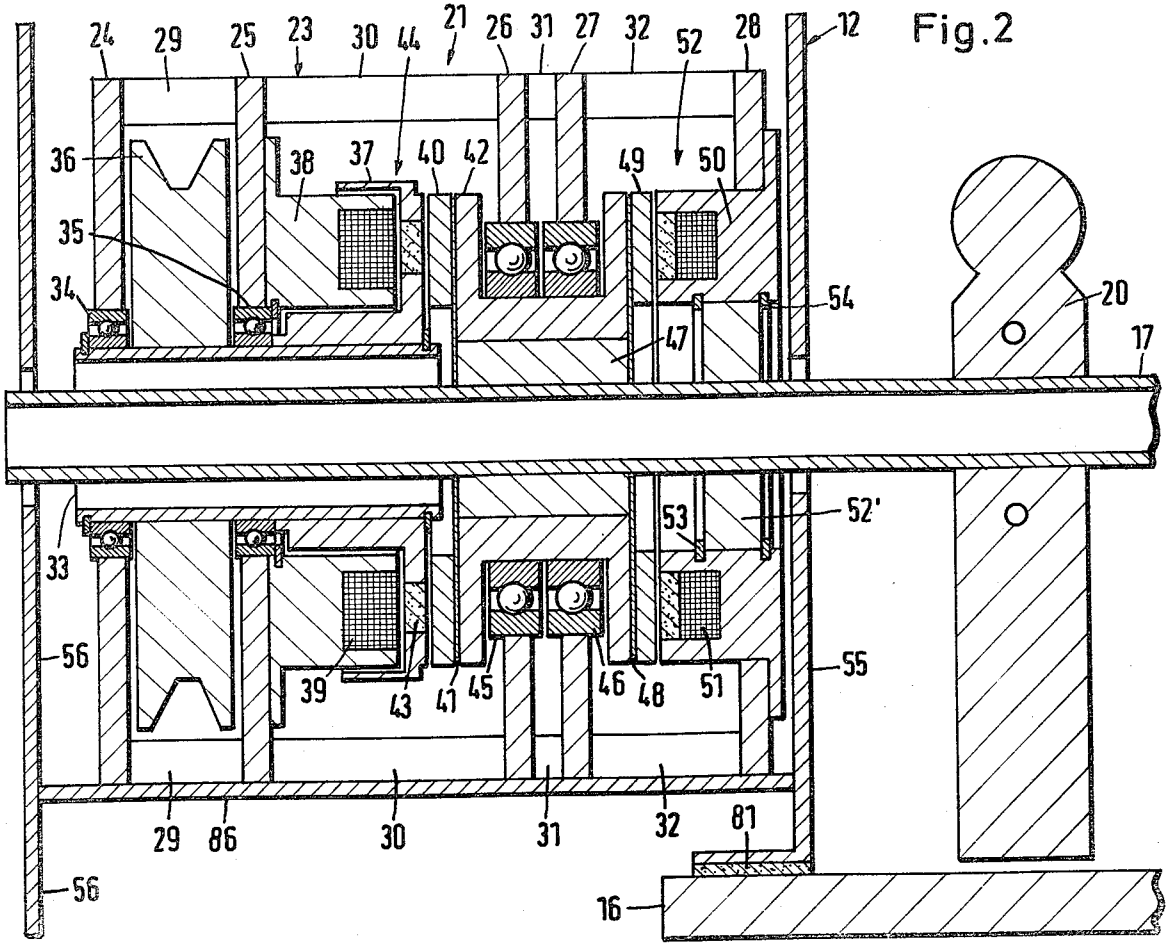
FIG. 2 is an enlarged sectional view taken on lines A—A of FIG. 1.
Figure 3:
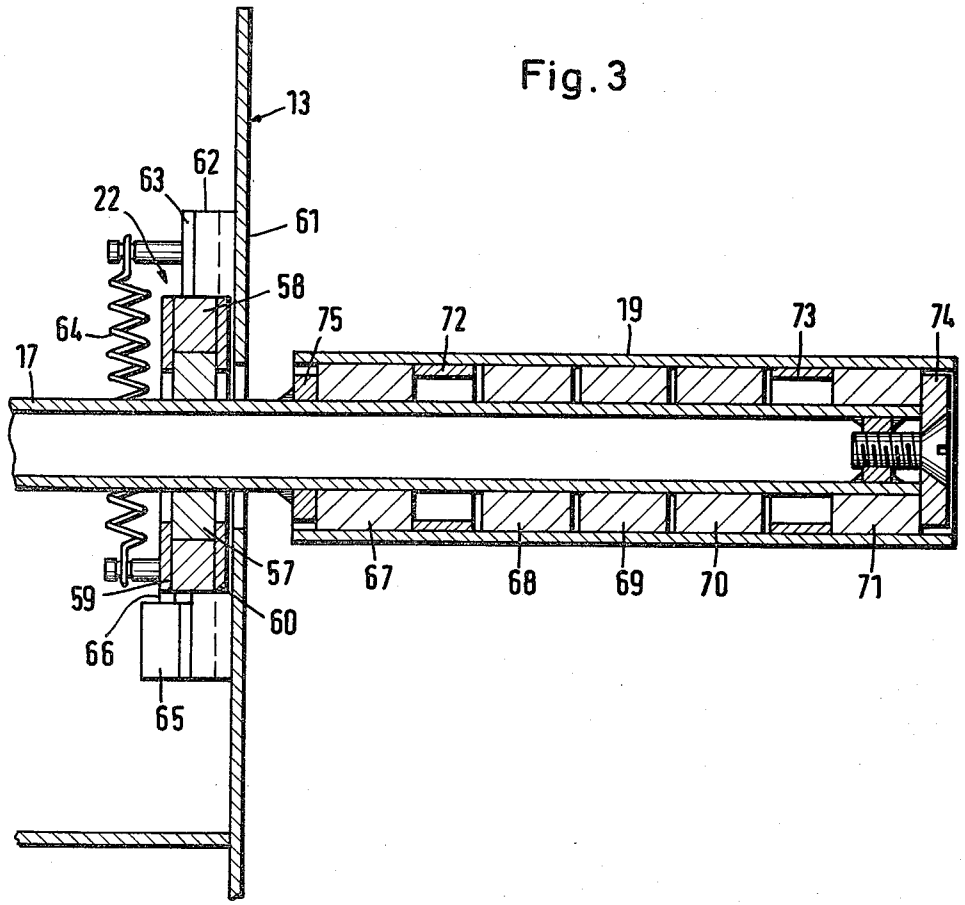
FIG. 3 is an enlarged sectional view taken on lines B—B of FIG. 1.

The FIGS. 2 and 3 show the build-up of the coupling and braking arrangement 21, the bearing 22 and the handle 19 of a transverse rod 17 in more detail in section.

According to FIG. 2, each coupling and braking arrangement 21 displays a frame 23, which consists of vertical plates 24, 25, 26, 27 and 28 as well as transverse members 29, 30, 31 and 32 connecting the plates. A bush 33 is journalled in ball bearings 34 and 35 in the plates 24 and 25. A driving wheel 36 is mounted secure against rotation on the bush 33. It stands in connection through a not illustrated V-belt with the driving wheels of further coupling and braking arrangements 21 and with the common rotary drive. Furthermore, a member 37 is arranged axially fast and secure against rotation on the bush 33. A further member 38, which contains a coil 39, is fastened to the plate 25. An iron ring 40 is connected through a spring ring 41 with a bearing ring 42. The spring ring 41 alternately connects with the iron ring 40 and the bearing ring 42. The member 37 furthermore contains a friction ring 43. The parts 37 to 43 form an electromagnetically actuable coupling 44. The bearing ring 42 is rotatably journalled by means of ball bearings 45 and 46 held in the plates 26 and 27. It sits secure against rotation on a bush 47 of synthetic material, which in turn is arranged secure against rotation on the transverse rod 17. The transverse rod is axially displaceable in the bearing 42 and the bush 47 displays a four-cornered passage corresponding to the four-cornered shape of the transverse rod 17. A further iron ring 49 is mounted secure against rotation through a further spring ring 48 on the bearing ring 42, while the spring ring 48 is likewise connected in circumferential direction alternately with the bearing ring 42 and the iron ring 49.

Fastened to the plate 28 is a further member 50, which contains a coil 51. The parts 42 and 48 to 51 form an electromagnetically actuable brake 52. In the cylindrical bore of the member 50, a sleeve bearing ring 52' of synthetic material is mounted rotatably between two securing rings 53 and 54 and secure against rotation on the transverse rod 17. The transverse rod 17 passes through the plates 55 and 56 of the longitudinal wall 12 as well as the bush 33 and is rotatable relative thereto. Furthermore, the transverse rod 17 is axially displaceable in the sleeve bearing ring 52'.

Referring to FIG. 3, each bearing 22 comprises a sleeve bearing ring 57 of synthetic material engaging the transverse rod 17, an outer sleeve bearing ring 58, in which the sleeve bearing ring 57 is rotatably journalled, and two securing washers 59 and 60, which are fastened to the outer sleeve bearing ring 58. The entire bearing 22 is mounted to be vertically displaceable in vertical guide rails 62, which are fastened to both sides of the bearing 22 at the inside of the outer boundary plate 61 of the longitudinal wall 13 and of which, in the sectional view, only one is visible, each guide rail 62 engaging a flange 63 extending parallel to the boundary plate 61 into a respective vertical (not illustrated) guide groove on each side of the sleeve bearing ring 58. A tension spring 64, of which only the one is visible in the sectional view, is fastened to flange 63 on the one hand and the securing washer 59 on the other hand. A switch 65, preferably a small snap-acting switch with upwardly projecting actuating plunger 66, is mounted fixed to the frame underneath the bearing 22. The plunger 66 actuates a working contact, and closes an operating current circuit to the coupling coil 39 as will be more fully described.

Through simple depression of the handle 19, the transverse rod 17 together with the bearing 22 can be pivoted downwardly against the force of the springs 64, the switch 65 actuated and the closing of the operating current circuit of the coupling coil 39 triggered. (No bending of the transverse rod 17 takes place by reason of the bearing play and the relatively great length of the transverse rod 17). The closing of the operating current circuit of the coupling coil 39 has the effect that creates a magnetic field that draws iron ring 40 against the force of the spring ring 41 towards the end face of the rotating member 37, constantly driven by the rotary drive through the driving wheel 36 and the bush 33, and entrained by the friction ring 43. The iron ring 40 sets the transverse rod 17 into rotation through the spring ring 41 and the bearing rings 42 and 47.

Before the run-down of a complete revolution of the transverse rod 17, the operating current circuit of the coupling coil 39 is interrupted automatically and the operating current circuit of the braking coil 51 is closed by a sensor scanning the rotational angle position of the bearing ring 42 and thereby of the transverse rod 17 (as will be more clearly explained by reference to FIG. 12). In sequence, the spring ring 41 removes the iron ring 40 from the member 37; the transverse rod 17 is decoupled from the rotary drive; the magnetic field of the brake coil 51 attracts the iron ring 49 against the force of the spring ring 48; and the transverse rod 17 is again braked through the iron ring 49, the spring ring 48 and the bearing rings 42 and 47.

The duration, during which the magnetic brake 52 is switched on is so chosen with respect to the angular speed of the transverse rod 17 that the transverse rod 17 is again at standstill after a complete revolution. The sensor scanning the rotary angle position beyond that takes care that the operating current circuit of the coupling coil 39 can be tripped only when the soccer playing figure 20 fastened to the transverse rod 17 is disposed in a small rotary angle region before the vertical position, which is illustrated in FIG. 2. On the other hand, the sensor again releases the braking operation after a complete revolution only in this rotary angle region. The driving speed is chosen to be so high that a complete revolution of the transverse rod 17 and thereby of the soccer playing figure 20 is concluded in a very brief time, about 40 milliseconds. Accordingly, a ball lying in front of the lower part (foot) of the soccer playing figure 20 receives a strong impact much greater than could be performed by manual rotation of the transverse rod 17. On the other hand, a soccer playing figure 20 is again within a short time disposed in the substantially vertical initial position that is also not attainable through manual rotation of the transverse rod 17. For this, it requires merely the downward exertion of a pressure on the handle 19. The required pressure movement is to be performed manually very much more simply than a rotary movement which moreover is necessarily limited to only a part of a complete revolution.

In order that the transverse rod 17 can easily turn in the actuating hand, each handle 19 (FIG. 3) is rotatably journalled on its transverse rod 17 by means of sleeve bearing rings 67 to 71 of synthetic material. These are arranged between securing rings 72 and 73, which are fastened to the handle 19, and securing rings 74 and 75 fastened to the transverse rod 17.

Figure 4:
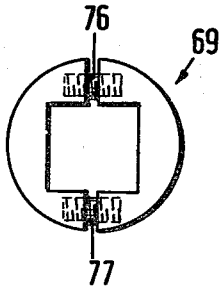
FIG. 4 is a side elevation of two mutually sprung sleeve bearing ring parts as they are contained in the handles of the transverse rods.

As FIG. 4 shows the sleeve bearing rings 68, 69 and 70 consist of two parts which are radially sprung against each other by compression springs 76 and 77. In this manner the handle 19 does not easily turn on the transverse rod 17 so that the transverse rod 17 can also be turned by means of the handle 19 in the ball bearings 45 and 46, in the member 50 and in the bearing 22 in order to bring the soccer playing figure 20 into the substantially vertical initial position or to turn it for kicking the ball away.

Figure 5:
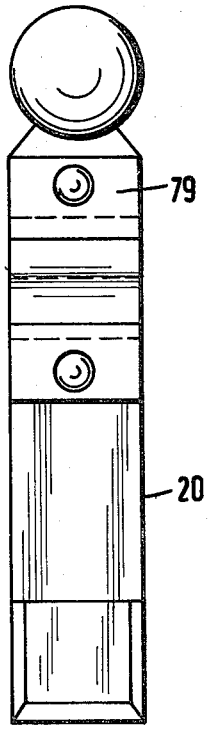
FIG. 5 is a front elevation of a playing figure.
Figure 6:
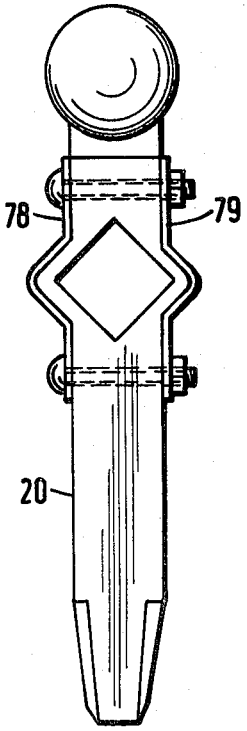
FIG. 6 is a side elevation of the playing figure according to FIG. 5.

The soccer playing figures 20 consist of elastic flexible material, preferably rubber, so that they bend on impinging obliquely onto the ball, which usually consists of harder material, and slide away over the ball without being damaged and/or blocking the drive. In order to keep them on the transverse rod 17 secure against rotation in spite of their elastic properties, they are in the region of their passage clamped fast on the transverse rod 17 between clamping brackets 78 and 79, as is illustrated in the FIGS. 5 and 6. If desired, however, only their part lying below the transverse rod 17 may consist of elastic material.

Figure 7:
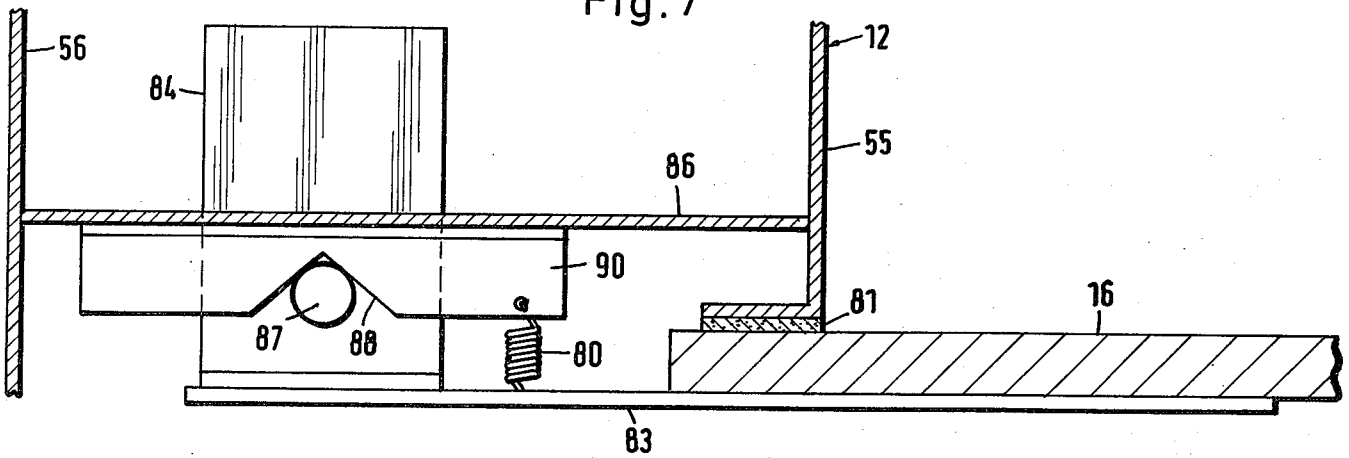
FIG. 7 is an enlarged sectional view taken on lines C—C of FIG. 1
Figure 8:
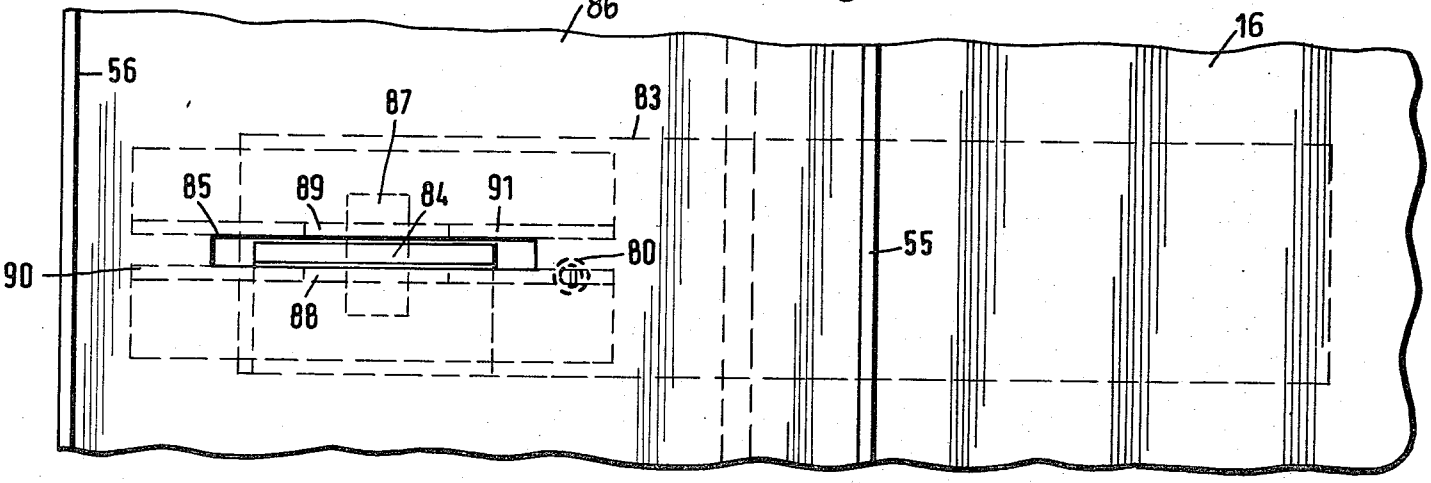
FIG. 8 is a plan view of FIG. 7.

As seen particularly in FIGS. 7 and 8, the bottom 16 is elastically suspended to the table frame at each corner through a spring 80 and a rubber buffer 81, which is horizontally continuously fastened between the bottom 16 and the walls 12 to 15 and at the same time acts as seal. By means of a further rod, which is fastened to the bottom 16 and which at both ends projects by handles 83 (FIG. 1) beyond the side walls of the box, the bottom 16 can be tilted somewhat out of its normal horizontal position by depression of one of the handles 82 in order to bring the ball, when it has come to rest in a position not reachable by a playing figure 20, into a reachable position, since the interior of the box 11 is not accessible because of the cover by the transparent pane (not illustrated) provided for safety reasons.

An arm 83 fastened to the bottom 16 displays an upstanding projection 84, which with longitudinal play projects through a guide slot 84 in the bottom 86 of the longitudinal wall 12 fixed to the frame. The projection 84 carries a transverse spigot 87, which engages in centring grooves 88 and 89 in walls 90 and 91 fastened vertically to the underside of the bottom 86 to both sides of the guide slot 85. The spring 80 is fastened between arm 83 and wall 90. This construction secures that the bottom 16 again returns automatically into its horizontal initial position after being pivoted.

Figure 9:
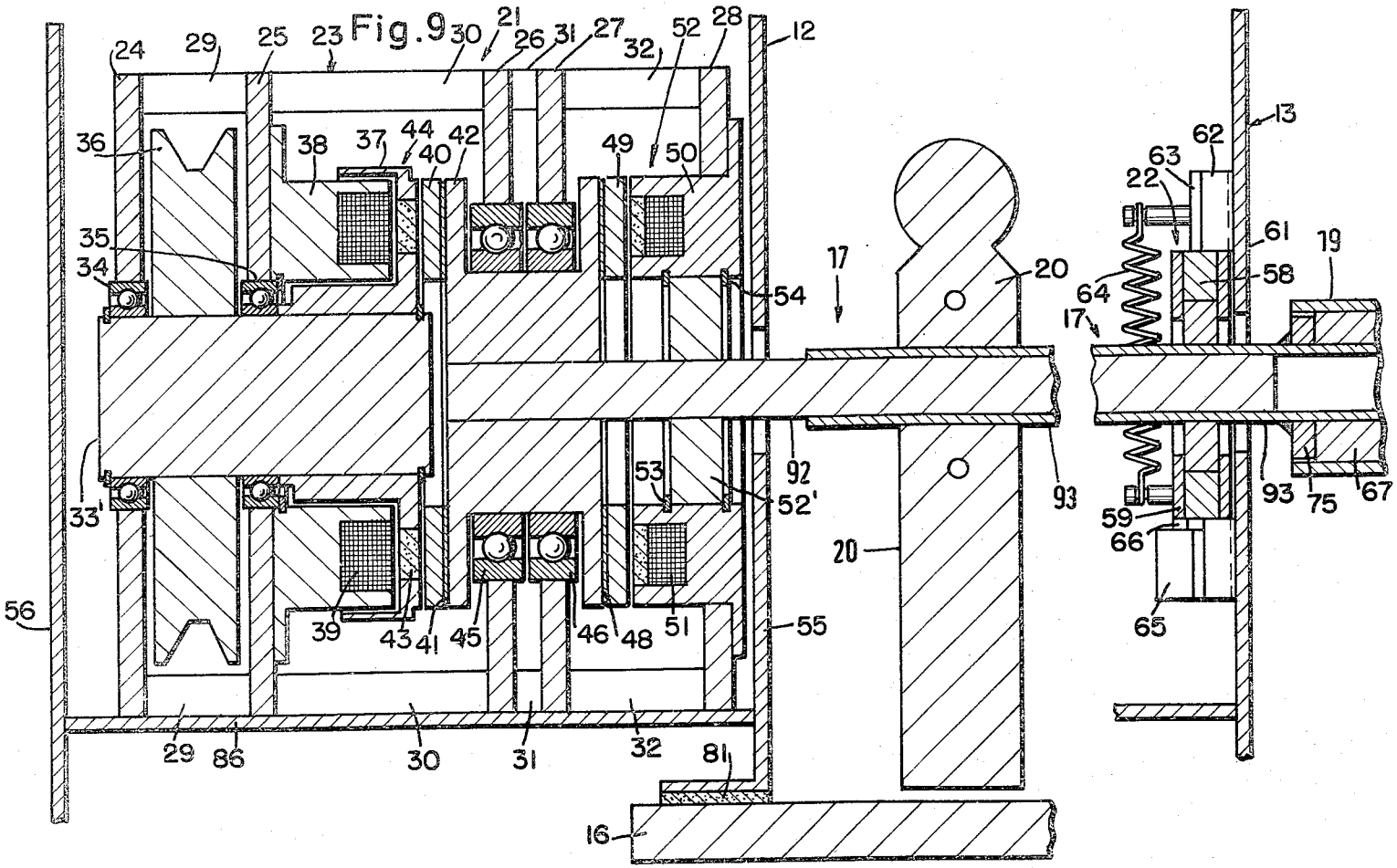
FIG. 9 is an enlarged sectional view of a second embodiment taken on lines AA—BB of FIG. 1.

FIG. 9 represents a second example of embodiment, which distinguishes itself from that according to the FIGS. 2 to 8 in that the transverse rods 17 are telescopic. One rod part 92 is fastened directly in the bearing ring 42 and the other rod part 93, which carries the soccer playing figure 20, is axially displaceable on the part 92. In this manner, the end of the transverse rod not provided with the handle 19 may not be pushed out laterally from the box 11 and possibly obstruct the other player or players.

Figure 10:
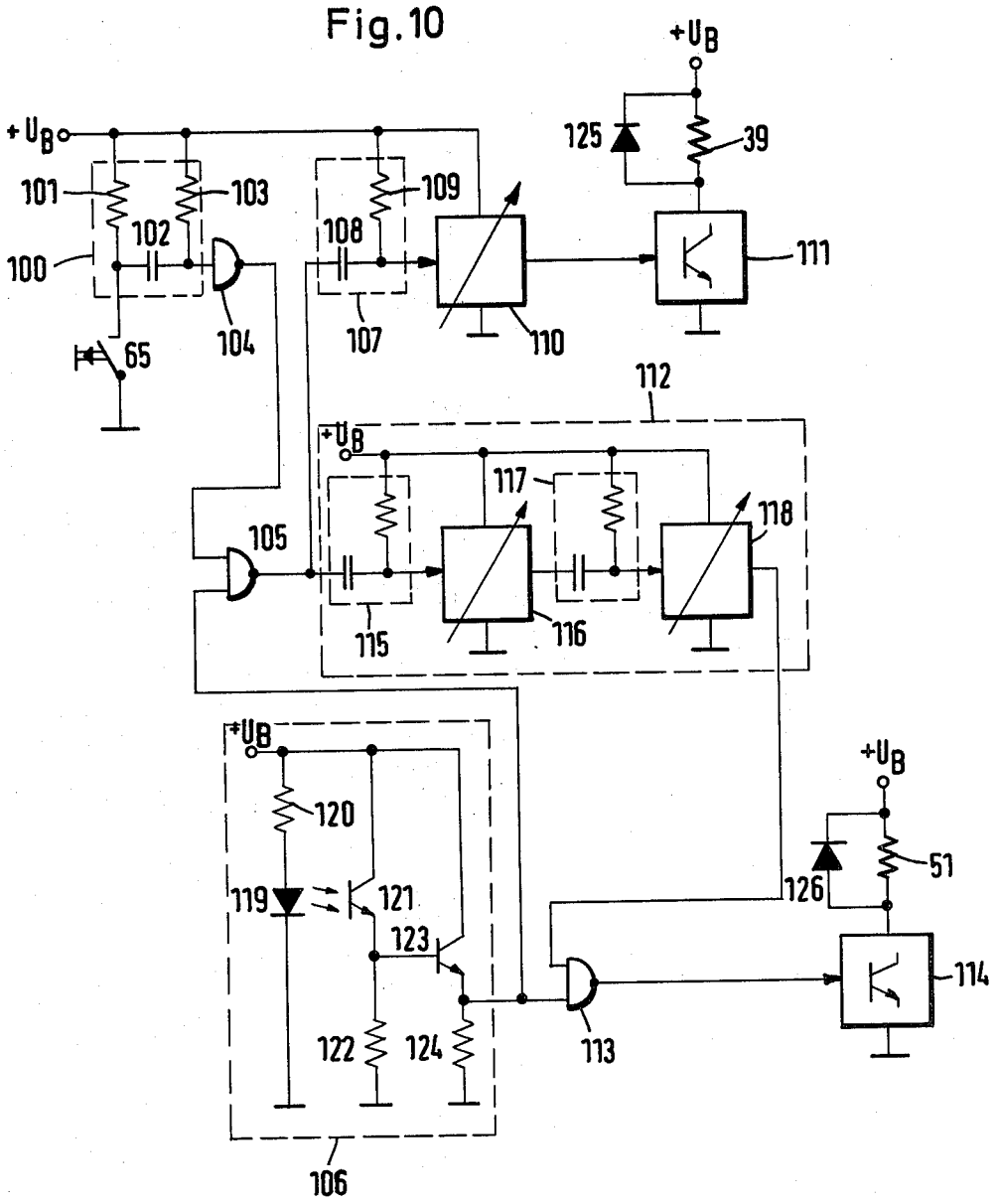
FIG. 10 is a circuit diagram of a coupling and brake control device.

FIG. 10 represents one of the electrical control devices, as they are provided for the coupling 44 and brake 52 of each transverse rod 17.

The control device is fed from an operating direct voltage source $U_B$ and contains a holding member 100 in series with the switch 65 for the bridging-over of contact bouncing of the switch 65. The holding member 100 contains a resistor 101 and, parallel thereto, a capacitor 102 in series with a resistor 103. The junction of capacitor 102 and resistor 103 forms the output of the holding member 100. This is connected through a NOR gate 104 that is coupled to one input of a logic element in the form of a NAND gate 105. The other input of the NAND gate 105 is connected with the output of the sensor 106 scanning the rotary angle position of the associated transverse rod 17. The output of the NAND gate 105 is connected through a differentiating member 107, consisting of a capacitor 108 and resistor 109, with the trigger input of an adjustable timing member 110 in the shape of a monostable trigger. The output of the timing member 110 is connected with the control input of a power amplifier 111 containing a Darlington transistor stage. This lies in series with the coupling coil 39 that is protected by diode 125, and connected to the operating direct voltage source $U_B$.

The output of the NAND gate 105 is connected through a timing stage 112 with the one input of a second logic element in the shape of an AND gate 113. The second input of the AND gate 113 is likewise connected with the output of the sensor 106. The output of the AND gate 113 is connected with the control input of a second power amplifier 114, which contains a Darlington transistor stage and which lies in series with the brake coil 51, protected by diode 126, and the operating direct voltage source $U_B$.

The time generator stage 112 contains a differentiating member 115, an adjustable timing member 116, a differentiating member 117 and an adjustable timing member 118 in series. The differentiating members are constructed just as the differentiating member 107.

The sensor 106 contains a luminescent diode (LED) 119 in series with dropping resistor 120, and energizes a light-sensitive transistor 121 with an ohmic resistor 122 in the emitter circuit and parallel thereto a transistor 123 with an ohmic resistor 124 in the emitter circuit, wherein the emitter of the transistor 121 is connected with the base of the transistor 123 and the emitter of the transistor 123 forms the output of the sensor 106.

The light of the luminescent diode 119 is directed to the circumference of the bearing ring 42. This is constructed to be reflecting only in a limited angular region. The light-sensitive transistor 121 receives the reflected light and converts it into a corresponding current. The voltage drop caused across the resistor 122 by this current is fed through the resistor 123 to the AND gate 113.

If one allocates the binary value "1" to a "high" voltage signal and the binary value "0" to a low voltage signal, then the timing members 110, 116 and 118 are triggered by a 1-0 transition at their trigger input, while their output signal, which in the rest position lies at "0", immediately goes over to "1" and retains this value for the duration of the set running time of the timing member. Thereafter, the output signal automatically returns to "0".

Thereby, the following manner of effect of the control equipment results.

Suppose the associated transverse rod 17 assumes a rotational angle position, in which the playing figure 20 stands immediately before its vertical position. In this position, the light of the diode 119 impinges on the reflecting peripheral region of the bearing ring 42 so that the light-sensitive transistor receives the reflected light and is turned on. Thus, a 1-signal appears at the output of the timing member 118 so that the AND gate 113 likewise delivers a 0-signal and the power amplifier 114 is not turned on. The brake coil 51 is thus free of current in this initial position of the transverse rod 17.

The 1-signal of the sensor 106 is further fed to the one input of the NAND member 105.

As long as the switch 65 is not closed, the NOR gate 104 receives a 1-signal from the retaining member 100 so that the NOR gate 104 feeds a 0-signal to the other input of the NAND-member 105 and forces from this the delivery of a 1-signal to the differentiating members 107 and 115. These differentiating members in their turn therefore apply 1-signal to the trigger inputs of the timing members 110 and 116 so that these are not triggered. Only when the switch 65 is closed (by depression of the associated handle 19) is a 0-signal forced at the input of the NOR gate 104 for a short time up to the charging-up of the capacitor 102. The NOR gate 104 therefore feeds a 1-signal likewise for a short time to the NAND member 105 so that a 0-signal appears for a short time at the output of the NAND-member 105 and triggers the timing members 110 and 116 through the differentiating members 107 and 115. The 1-signal thereupon appearing at the output of the timing member 110 turns on the power amplifier 111 so that current flows through the coupling coil 39 and the coupling 44 is engaged. The transverse rod 17 is therefore driven at very high angular speed by the constantly running rotary drive practically at once on actuation of the handle 19 for the duration of the running time of the timing member 110. The running times of the timing members 110 and 116 are chosen to be shorter than the duration of one revolution of the transverse rod 17. The running time of the timing member 116 is however chosen to be somewhat longer than that of the timing member 110. Only after the running time of the timing member 110 has run down and the current in the coupling coil 39 is interrupted, a 0-signal thus again appears at the output of the timing member 116 and through the differentiating member 117 at once triggers the timing member 118 so that this feeds a 1-signal to the AND-member 113. During the first part of the revolution of the transverse rod 17, the reflecting region of the bearing ring 42 has however been turned out of the ray path of the diode 119 so that the output signal of the sensor 106 is again "0" during this time. Only after the reflecting region of the running ring 42 has again been turned into the ray path and the 1-signal appears at the output of the timing member 118, the AND-member 113 receives a 1-signal at both inputs so that it turns the power transistor 114 on through delivery of a 1-signal and a current flows through the brake coil 51. The braking operation thus sets in after run-down of the driving phase and before the end of a complete revolution of the transverse rod 17, while the braking force is so dimensioned that the rotary movement still comes to standstill within the rotary angle ragion, in which the light of the diode 119 impinges on the reflecting region of the bearing ring 42. The transverse rod 17 therefore executes practically a complete revolution after actuation of its handle 19 independently of the duration of this actuation so that the playing figure 20 at once again assumes its about vertical initial position, in which it is ready to kick. It is however also possible so to choose the running times of the timing members 110, 116 and 118 that the transverse rod executes a further or several complete revolutions so that the playing figure 20 in its turn immediately shoots back a ball shot or bouncing back at once.

We claim:

1. A ball game apparatus comprising a box with side walls, transverse rods, each rod carrying at least one playing figure, each rod extending across said box and being journalled in opposite side walls of the box and being rotatable about its longitudinal axis and at least the part of said rod carrying the playing figure also being displaceable longitudinally, the playing figure carrying part of the rod extending through one wall of said box and outwardly thereof, a handle being rotatably journalled to the outwardly extending portion and held thereon against relative longitudinal movement, a rotary drive for said rods to rotate said rods about their longitudinal axes, a coupling means for selectively coupling each rod to said rotary drive, and a brake means for arresting rotation of each rod at about the end of a complete revolution.

2. A device as in claim 1 wherein the coupling means comprises for each rod a ring surrounding the rod and fixed against rotation relative thereto, and wherein for each rod there is a first electromagnetic element rotatably coupled to said rotary drive and coaxially surrounding the rod and wherein the brake means includes a second electromagnetic element surrounding the rod and fixed against rotation relative to the box, said ring being in the magnetic flux line of the coupling means and the brake means

3. A device according to one of the claims 1 or 2 wherein each transverse rod is pivotably mounted in said box, and means for actuating said coupling means by a pivotal movement of its transverse rod.

4. A device as in claim 3 wherein each transverse rod is mounted to pivot in a vertical plane, and said means for actuating comprises a switch associated with said rod positioned to be operated upon downward movement of the rod.

5. A device as in claim 4 wherein an electrical control means is provided that includes a logic element, said logic element input connected with said switch, a transverse rod rotational angle sensor responsive to the vertical position of the ball playing figure and coupled to a second input of the logic element, a timing circuit, a timing generator, the output of the logic element coupled to said timing circuit and to said timing generator, the output of the timing circuit coupled to the coupling means, a second logic element, the timing generator output and the angle sensor output coupled to the inputs of the second logic element, the output of said second logic element being coupled to said brake.

6. A device as in claim 1 wherein the transverse rods are multisided and are mounted in correspondingly multisided passages of axially fast, rotatably journalled bearing rings.

7. A device as in claim 1 wherein the transverse rods comprise at least two telescopic sections, and the sections remote from the handles are axially stationary relative to said walls.

8. A device as in claim 1 wherein the box is covered by a transparent pane and the box has a bottom wall that is mounted to be pivotable relative to the side walls of the box.

9. A device as in claim 1 wherein the playing figure consists of elastically flexible material and is clamped to the transverse rod.

* * * * *